US005348104A

United States Patent [19]

Torfs

[11] Patent Number: 5,348,104

[45] Date of Patent: Sep. 20, 1994

[54] ROTARY DRIVE ASSEMBLIES

[76] Inventor: Walter F. Torfs, R.R. #2, Uxbridge, Ontario, Canada, L9P 1R2

[21] Appl. No.: 57,899

[22] Filed: May 7, 1993

[51] Int. Cl.[5] ..... E21B 3/04

[52] U.S. Cl. ..... 173/151; 173/152; 173/216

[58] Field of Search ..... 173/216, 217, 152, 157, 173/151, 145, 147

[56] References Cited

U.S. PATENT DOCUMENTS

| | | | |
|---|---|---|---|
| 1,363,586 | 12/1920 | Hansen | 173/152 |
| 1,484,362 | 2/1924 | Stone | 173/152 X |
| 1,678,307 | 7/1928 | Stone | 172/152 X |
| 3,623,558 | 11/1971 | Brown | 173/216 X |
| 3,800,887 | 4/1974 | West | 173/152 X |
| 3,830,315 | 8/1974 | Love | 173/151 X |
| 4,150,727 | 4/1979 | Shepherd | 173/147 |
| 4,393,945 | 7/1983 | Rassieur | 173/152 X |
| 4,423,645 | 1/1984 | Abbott et al. | 173/216 X |
| 4,984,641 | 1/1991 | Pryor | 173/216 X |

*Primary Examiner*—Rinaldi I. Rada

*Attorney, Agent, or Firm*—Shoemaker and Mattare, Ltd.

[57] ABSTRACT

A well assembly including a drive string, a frame, a spindle mounted on the frame and means for rotating the spindle, is constructed to allow the upper end of the string to pass through the spindle. A nut with a non-circular downward protuberance is tightly, threadably engaged with the upper end of the drive stung. The spindle has a non-circular upward protuberance, and a tail bar snugly receives both protuberances. The tail bar supports the weight of the string and transmits rotary torque from the spindle to the string.

10 Claims, 4 Drawing Sheets

ROTARY DRIVE ASSEMBLIES

This invention relates to improvements in rotary drive assemblies, and particularly to such assemblies utilized in the suspension and rotation of a well string, such as a rod string.

BACKGROUND OF THIS INVENTION

Many conventional oil wells are operated by a downhole pump at or close to the bottom of the well, the pump being of a reciprocating kind and actuated by a rod string which in turn is reciprocated vertically by a pump jack. Recently, rotary drive progressive cavity pumps have been installed to replace the pump jack vertically actuated reciprocating pumps. Such rotary pumps are particularly suited for the production of crude oil laden with sand and water.

In the earlier construction, using simple reciprocation to operate the pump, the string is secured to the pump jack by the intermediary of a two-piece clamp secured around the top end of the rod string, and tied to the pump jack by wires or the like. Although such clamps were adequate for the simple vertical reciprocation of the rod string, they operate close to the limit when required to transmit torque to the string as well as to support the weight of the string and the downhole rotor.

At high torque values, the conventional clamp tends to slip with respect to the drive string, allowing the latter to move downwardly. For this reason, a backup clamp is often mounted behind (above) the pump jack clamp. This means that the drive string cannot be mounted at the bottom position, since some margin must be left for slippage. The typical approach has been to raise the drive string by approximately one foot, to allow for possible slippage. However, if the pump rotor is raised or lowered after slippage with respect to the pump stator at the bottom of the well, the full capacity of the pump is not available. In order to use the full capacity of such a pump, a positive position lock and drive system must be utilized, i.e. one in which there is no risk that the rod string will slip downwardly.

The Prior Art

A primary patent relating to the conversion of oil wells from a reciprocating string to a rotary string is Canadian Patent No. 1,153,307, issued Sep. 6, 1983 to Corod Manufacturing Ltd. This patent addresses the matter of transferring torque to the drive string from a sleeve member through which the top end of the drive string projects. The solution offered by Canadian patent 1,153,307 utilizes the conventional two-part clamp (of the kind originally employed with reciprocating pumps), and allows the clamp to be received in a suitably shaped recess or pocket in the top of the sleeve. Unfortunately, this construction places tremendous shear forces on the upper portions of the sleeve member which are called upon to transmit the torque from the sleeve member to the clamp, and thence to the rod string. Shear failure tends to occur in the sleeve member at the locations where the highest shear stress is found.

DESCRIPTION OF THIS INVENTION

In view of the above-mentioned shortcomings of the prior art, the present invention is such as to allow the installer to position the drive rod exactly where he wants it to be, with no possibility of the production string slipping downwardly. The rod string is mechanically interlocked with a member which is in turn rotated and supported from the sleeve, and does not utilize a clamp of any kind. Thus, the present construction avoids the risk of clamp rotation with respect to the rod, and the rod damage which usually results.

In accordance with a first aspect of this invention, an improvement is provided for a well assembly that includes: a drive string having a threaded upper end, a stationary frame, a spindle rotatably mounted on the frame and having an axial bore through which the drive string extends, first means for rotating the spindle, and second means for suspending the drive string from the spindle. According to the improvement, said second means includes a nut member threadably engaged with said threaded upper end on the drive string, the nut member having a non-circular, downwardly projecting first protuberance, and the spindle having a non-circular, upwardly projecting second protuberance. A tail bar is provided in the form of a sleeve member having a non-circular first end for snugly receiving said first protuberance and a non-circular second end for snugly receiving said second protuberance, the taxi bar surrounding said drive string, whereby the non-circularity of the protuberances and the ends of the tail bar ensure that the string, the nut member, the tail bar and the spindle all rotate together.

GENERAL DESCRIPTION OF THE DRAWINGS

Several embodiments of this invention are illustrated in the accompanying drawings, in which like numerals denote like parts throughout the several views, and in which.

DETAILED DESCRIPTION OF THE DRAWINGS

Figure 1:
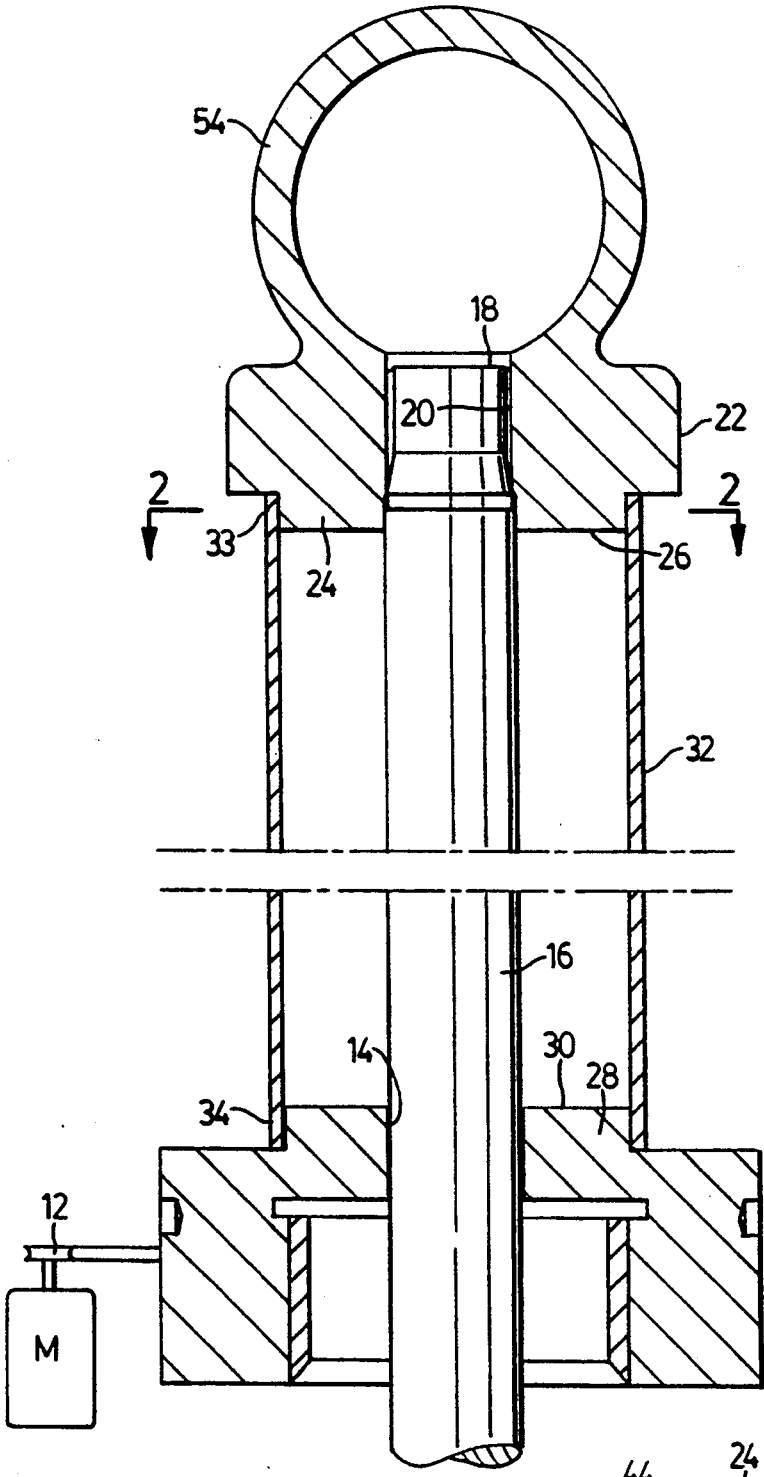
FIG. 1 is a vertical axial section through the upper portion of one embodiment of a rotary sleeve, and the construction which ensures that the drive string rotates with the sleeve, but cannot slip down axially with respect thereto.

In FIG. 1, the top end of a spindle for supporting and rotating the drive string is illustrated at the numeral 10. Means are provided for supporting the spindle 10 with respect to a main frame, and further means are provided for rotating the spindle 10. In FIG. 1, such further means is schematically illustrated at lower left by a motor M and a belt pulley 12. It is emphasized that this illustration is merely a schematic representation of a suitable means. More typically, such means would include a positive gear drive of which there are many examples in the mechanical art.

The spindle 10 has an axial bore 14 through which extends the upper end of a drive string 16. The top end of the drive string 16 has an external thread at 18 which tightly engages a corresponding internal thread 20 on a nut member 22. The direction of the engaging threads 18 and 20 is such that, when torque is applied to the drive string 16 in the direction corresponding to pump operation, the threaded engagement tightens.

Figure 2:
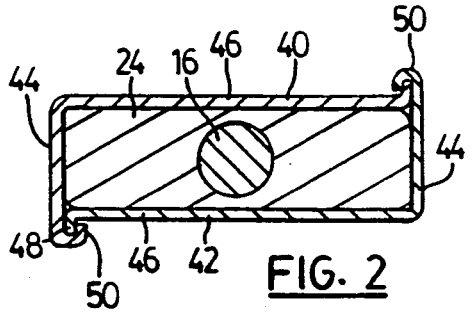
FIG. 2 is a cross-sectional view taken at the line 2—2 in FIG. 1.

The nut member 22 has a non-circular, downwardly projecting first protuberance 24, the preferred configuration of which is best seen in FIG. 2. It will be noted that, for the embodiment illustrated, the protuberance 24 has the shape of a rectangle with two longer sides and two shorter sides. The first protuberance 24 has a flat, rectangular bottom wall 26.

In like manner, the spindle 10 has a non-circular, upwardly projecting second protuberance 28 which in this embodiment has substantially the same cross-section as the first protuberance 24.

The second protuberance 28 has a rectangular top wall 30 and includes two longer sides and two shorter sides.

A tail bar 32 is provided, in the form of a sleeve member with a non-circular first end 33 for snugly receiving the first protuberance 24, and a non-circular second end 34 for snugly receiving the second protuberance 28. The tail bar 32 surrounds the drive string 16.

With the construction just defined, the non-circularity of the protuberances 24 and 28 and the non-circularity of the corresponding ends 33 and 34 of the tail bar 32, ensures that the drive string 16, the nut member 22, the tail bar 32 and the spindle 10 all rotate together. Further, the nut member 22 and the tail bar 32 ensure that the weight of the drive string 16 is carried by the spindle 10.

In one preferred embodiment illustrated in FIG. 2, the sleeve member constituted by the tail bar 32 includes two identical portions 40 and 42 which interfit with each other. More particularly the identical portions 40 and 42 are L-shaped and each includes (seen in section in FIG. 2) a shorter leg 44 and a longer leg 46, the legs being substantially at right-angles to each other. In the embodiment illustrated, the longer leg 46 has an out-turned flange 48, while the shorter leg 44 has a hooked configuration 50 which is adapted to capture the corresponding out-turned flange 48 of the other portion.

It is also preferred that the tail bar 32 constituting the sleeve member have a constant cross-section for ease of manufacturing. By making the portions 40 and 42 identical, the total number of different parts required for a given installation is reduced.

Returning to FIG. 1, it will be noted that the nut member 22 is provided with an upper ting configuration 54, the purpose of which is to facilitate grasping the nut member when it is desired to raise the drive string.

Figure 8:
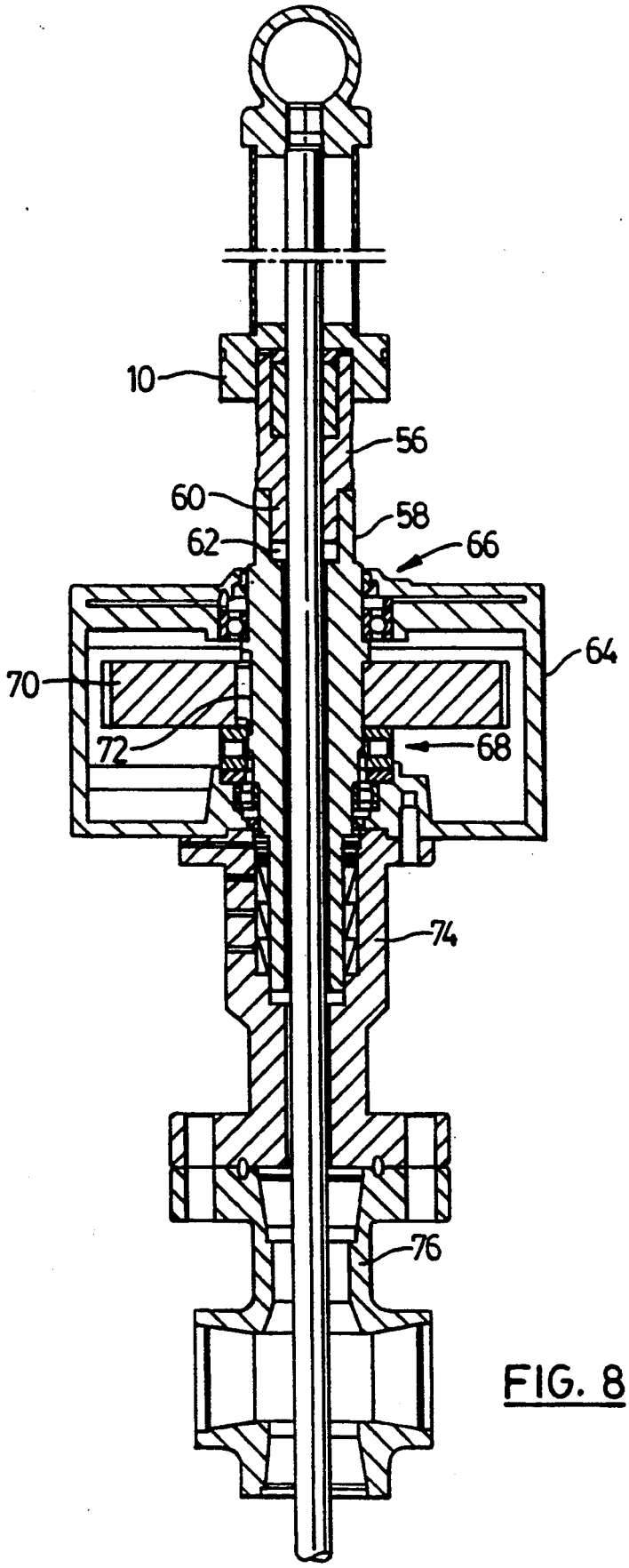
FIG. 8 is similar to FIG. 1, but on a smaller scale, showing structure for supporting and rotating the drive string.

To give a fuller grasp of the construction with which this invention finds use, attention is directed to FIG. 8. The upper portion of FIG. 8 is the structure shown in FIG. 1, and therefore the description that follows deals only with the various components below the component 10. As seen in FIG. 8, the component 10 is only the uppermost portion of a vertically elongated spindle which includes a first sleeve member 56 which interlocks with a second sleeve member 58, by virtue of the first sleeve member 56 having a downward, non-circular extension 60 which is received snugly and non-rotatably in a recess 62 defined at the top of the second sleeve member 58. With this interfitted construction, the first and second sleeve members 56 and 58 always rotate together. A similar non-rotating fit takes place between the first sleeve member 56 and the component 10.

A stationary housing 64, forming pan of a main frame, supports bearings 66 and 68 which in turn support the second sleeve member 58 for free rotation within the housing 64. A belt-driven disk 70 is supported on the second sleeve member 58 and is keyed thereto by a key 72. The disk 70, and thus also the sleeve members 56 and 58 as well as the component 10, are rotated together in unison by an endless belt or the like, which in turn is driven by a suitable motor (refer to FIG. 1 ).

Further stationary members are illustrated in FIG. 8 and include a stationary support pedestal 74, which is supported from a fitting 76. The items 74 and 76 do not lie at the focus of this invention, and do not need to be described in greater detail.

Figure 3:
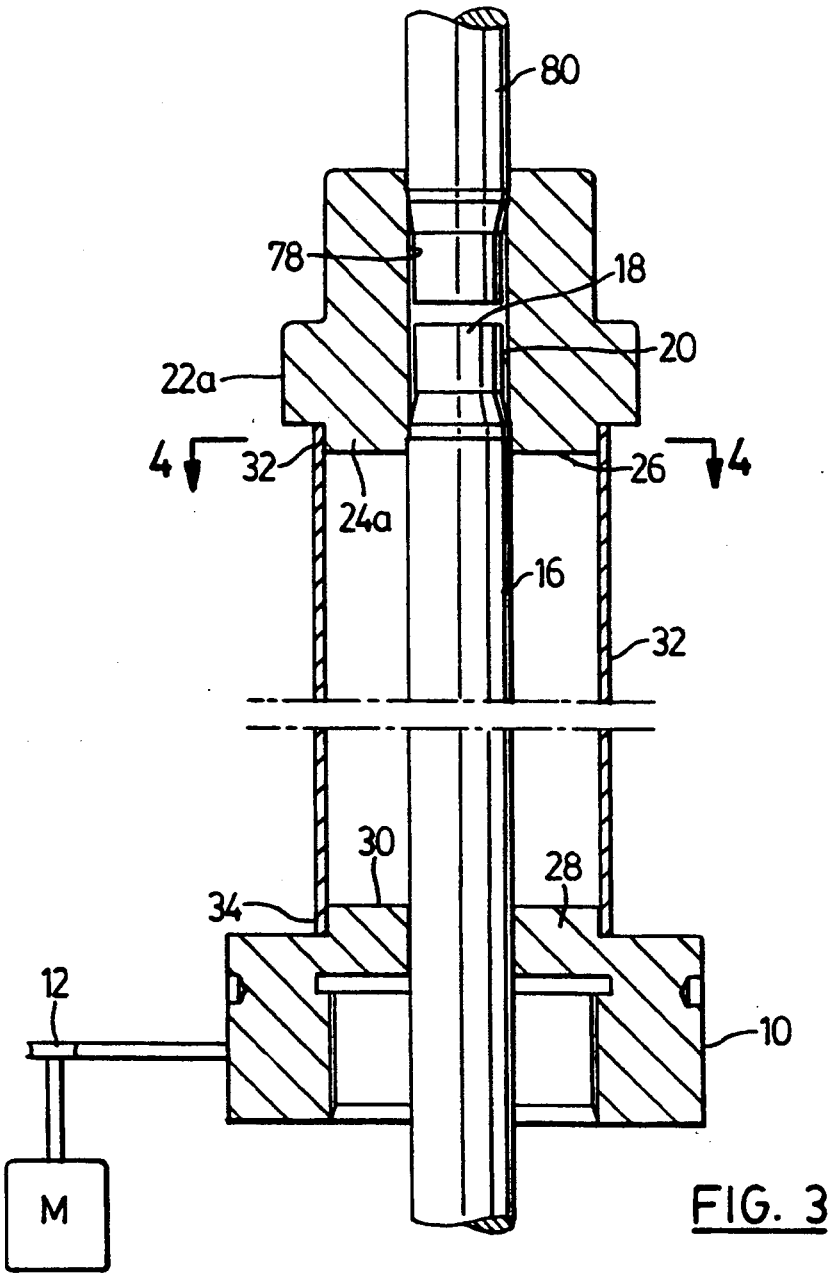
FIG. 3 is a vertical axial section through the upper portion of a second embodiment of a rotary sleeve.

Attention is now directed to FIG. 3, which differs from FIG. 1 only in the configuration of the nut member **22*a*. In FIG. 3, the nut member 22*a* is a solid member with an internal bore traversing its full height, the bore being internally threaded. The drive string 16 engages the lower portion of the central threaded bore 78 of the nut member 22*a*. When it is desired to raise the drive string 16, a shaft 80 with an external thread at its lower end is screwed into the upper portion of the bore 78. A mechanism (not shown) is utilized to raise the shaft 80, and thus the entire drive string 16**.

Figure 4:
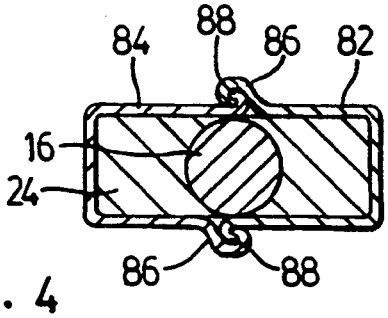
FIG. 4 is a cross-sectional view taken at the line 4—4 in FIG. 3.

FIG. 4 illustrates a different configuration for the portions constituting the tail bar. Specifically, there are provided two portions 82 and 84, each being C-shaped in section and having two free edges. Each portion 82, 84 has a loop configuration 86 at one free edge and a tab configuration 88 at the other free edge, whereby the portions may be assembled together as seen in FIG. 4, with the tab configuration 88 of each part being received within the loop configuration 86 of the other portion.

Figure 5:
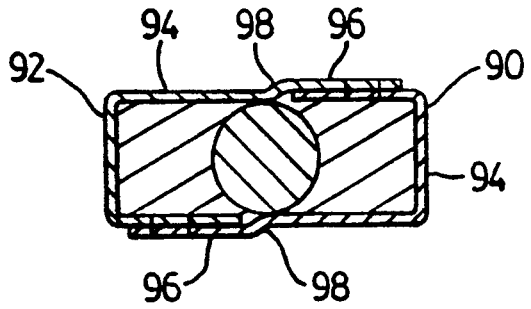
FIGS. 5, 6 and 7 are cross-sectional views, similar to FIGS. 2 and 4, showing alternative constructions for one of the major components of this invention.

Attention is now directed to FIG. 5, which shows an alternative cross-sectional configuration for the tail bar. In FIG. 5, there are two identical portions 90 and 92, each portion defining, in section, a C-shaped part 94 and a flange 96, each flange 96 being joined to its respective C-shaped part 94 through an angulated transitional part 98, whereby the portions can nestably interfit as illustrated, with the flange 96 of each portion juxtaposed against the C-shaped part 94 of the other portion. A suitable fastener (for example a threaded bolt) can be provided to secure each flange 96 to the C-shaped part 94 against which it is juxtaposed.

Figure 6:
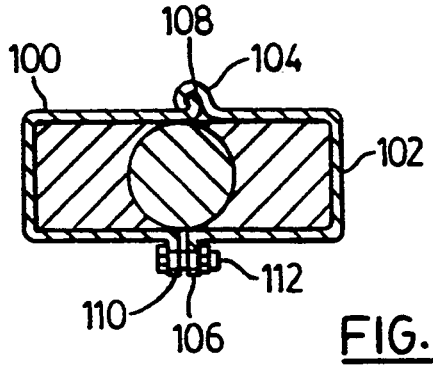

Attention is now directed to FIG. 6, in which a further embodiment of the tail bar section is illustrated. In FIG. 6, there are two different portions 100 and 102, each defining a C-shaped section having two free edges. The portion 102 has a loop configuration 104 at one of its free edges, and a flange 106 at the other free edge. The other portion 100 has a tab configuration 108 at one free edge (the upper one) and a flange 110 at the other free edge. As can be seen in FIG. 6, the portions are assembled with the tab configuration 108 of portion 102 received within the loop configuration 104 of the portion 100, with the flanges 106 and 110 parallel and juxtaposed, and suitable fastener means 112 (a nut and bolt) is used for securing the flanges 106 and 110 together.

Figure 7:
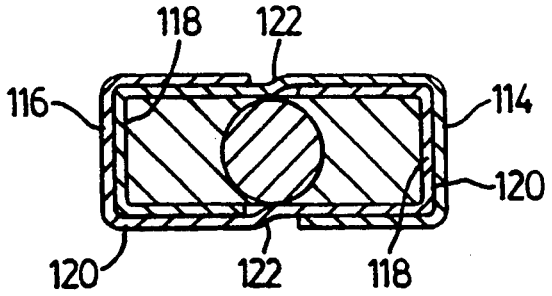

Finally, attention is directed to FIG. 7, in which there are provided two portions 114 and 116 which are identical. Each portion 114, 116 defines, in section, a smaller C-shaped half 118 and a larger C-shaped half 120. The halves of each portion are joined together by an integral, angulated transitional part 122, whereby the portions 114 and 116 can be nestably interfitted together so that the larger half 120 of each portion snugly surrounds the smaller half 118 of the other portion. In the embodiment if FIG. 7, no special fastening means needs to be provided, and the tail bar thus constituted would be stronger than the other embodiments due to the fact that it has a double wall.

The construction provided herein eliminates the need for clamping means between the spindle and the drive string, and thus does not face the risk of clamp slippage, which would allow the drive string to slip downwardly. This construction therefore offers the advantage of allowing the drive string 16 to be positioned as low as is necessary for the full utilization of the pump capacity.

It will further be understood that the first and second protuberances 24 and 28 may have different cross-sectional configurations, so long as the configurations are non-circular and so long as the sleeve member defined by the tail bar 32 snugly receives both protuberances.

It will be understood that the tail bar will be made of a material and will have a thickness which are appropriate for the compressive and torsional stresses that will be applied to it during operation.

While several embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In a well assembly that includes
a drive string having a threaded upper end,
a stationary frame,
a spindle rotatably mounted on the frame and having an axial bore through which the drive string extends,
first means for rotating the spindle, and
second means for suspending the drive string from the spindle,
the improvement wherein said second means includes a nut member threadably engaged with said threaded upper end on the drive string, the nut member having a non-circular, downwardly projecting first protuberance, and the spindle having a non-circular, upwardly projecting second protuberance, and a tail bar in the form of a sleeve member having a non-circular second end for snugly receiving said second protuberance, the tail bar surrounding said drive string, whereby the non-circularity of the protuberance and the ends of the tail bar ensure that the string, the threaded member, the tail bar and the spindle all rotate together.

2. The improvement claimed in claim 1, wherein the sleeve member comprises two identical shell portions, which mate with each other, on opposite sides of the drive string.

3. The improvement claimed in claim 2, wherein the identical portions are substantially L-shaped, each said portion defining, in section, a shorter leg and a longer leg substantially at right-angles to each other, said portions when assembled defining a rectangle in cross-section, one leg of each portion having a hooked configuration, the other leg of each portion having an out-turned flange adapted to be captured in said hooked configuration of said one leg of the other portion.

4. The improvement claimed in claim 2, wherein each said shell portion defines, in section, a smaller C-shaped half and a larger C-shaped half, the halves of each portion being joined by an angulated transitional part, whereby the portions can nestably interfit such that the larger half of each portion snugly surrounds the smaller half of the other portion.

5. The improvement claimed in claim 2, wherein each said shell portion has in section, a C-shaped part and an offset flange projecting from one side the C-shaped part, whereby the portions mate with the flange of each portion juxtaposed against the C-shaped part of the other portion.

6. The improvement claimed in claim 2, wherein each said shell portion defines in section a C-shaped part having two free edges, each portion having a loop configuration at one free edge and a tab configuration at the other free edge, whereby the portions may be assembled with the tab configuration of each portion received within the loop configuration of the other portion.

7. The improvement claimed in claim 2, wherein each said shell portion defines in section a C-shape having two free edges, one portion having a loop configuration at one free edge and a flange at the other free edge, the other portion having a tab configuration at one free edge and a flange at the other free edge, whereby the portions may be assembled with the tab configuration of one portion received within the loop configuration of the other portion, and with the flanges parallel and juxtaposed, and fastener means for securing the flanges together.

8. The improvement claimed in claim 1, wherein the sleeve member is elongate and has a constant cross-section, and in which the two protuberances are substantially identical in cross-section, each said protuberance having the shape of a rectangle when viewed in the longitudinal direction of the sleeve member.

9. The improvement claimed in claim 1, wherein the upper end of the drive string is externally threaded and a ring is affixed to the nut., to facilitate grasping the threaded member when it is desired to raise the drive string.

10. The improvement claimed in claim 1, wherein the upper end of the drive string is externally threaded, and the nut member has an internal thread matching said external thread, said internal thread being open at both ends and sufficiently long to allow it simultaneously to engage both the drive string, and an external thread on a lifting rod adapted to raise the drive string.

* * * * *